United States Patent [19]

Powell et al.

[11] Patent Number: 4,904,208

[45] Date of Patent: Feb. 27, 1990

[54] CONNECTOR SYSTEM WITH MODULAR SOCKET INSERT ASSEMBLY

[75] Inventors: Lloyd J. Powell, Newmarket; John B. Gerow, Oshawa, both of Canada

[73] Assignee: ITT Corporation, New York, N.Y.

[21] Appl. No.: 908,861

[22] Filed: Sep. 10, 1986

Related U.S. Application Data

[63] Continuation of Ser. No. 748,111, Jun. 24, 1985, abandoned.

[51] Int. Cl.[4] ..... H01R 25/00

[52] U.S. Cl. ..... 439/654; 439/752

[58] Field of Search ..... 339/94 R, 94 M, 248, 339/249, 256, 258, 262, 154 R, 154 A, 156, 136 R, 136 M, 64 R, 64 M, 242, 243, 196 M, 206 R, 206 P

[56] References Cited

U.S. PATENT DOCUMENTS

| | | | |
|---|---|---|---|
| 2,383,926 | 8/1945 | White | 339/191 M |
| 2,658,183 | 11/1953 | Klostermann et al. | 339/64 M |
| 2,829,358 | 4/1958 | Testori | 339/136 R |
| 3,017,597 | 1/1962 | Nava et al. | 339/64 M |
| 3,654,595 | 4/1972 | Curr | 339/262 R |
| 3,924,922 | 12/1975 | DeCenzo | 339/262 R |
| 4,221,447 | 9/1980 | Powell | 339/136 M |
| 4,304,457 | 12/1981 | Lissau | 339/256 R |
| 4,402,566 | 9/1983 | Powell et al. | 339/94 M |
| 4,488,765 | 12/1984 | Erbe | 339/111 |
| 4,540,230 | 9/1985 | Iversen et al. | 339/94 M |

FOREIGN PATENT DOCUMENTS

| | | |
|---|---|---|
| 1953302 | 6/1970 | Fed. Rep. of Germany . |
| 3041337 | 9/1982 | Fed. Rep. of Germany . |
| 2023357 | 12/1979 | United Kingdom . |
| 1594183 | 7/1981 | United Kingdom . |

*Primary Examiner*—David Pirlot

*Attorney, Agent, or Firm*—Thomas L. Peterson

[57] ABSTRACT

A modular socket insert assembly is described, which can fit into the male ends of two substantially identical connectors to connect them, wherein the socket insert assembly can be easily taken apart in the field for cleaning or replacement of a damaged socket. The socket insert assembly includes a pair of insulators having inner ends that substantially abut one another and having aligned holes for holding a group of separate socket modules. The hole in each insulator is wide at the inner end of the insulators where they abut one another, and is narrowed at the outer ends of the insulators, to trap a socket module in place.

1 Claim, 2 Drawing Sheets

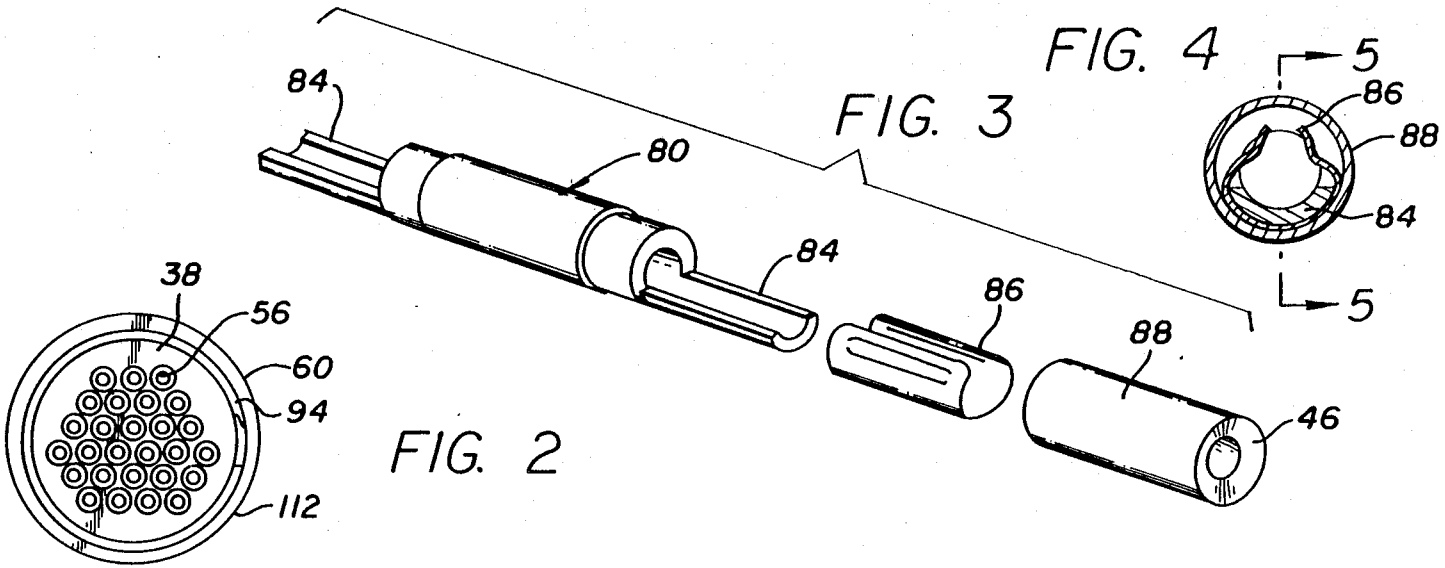
FIG. 4
FIG. 3
FIG. 2
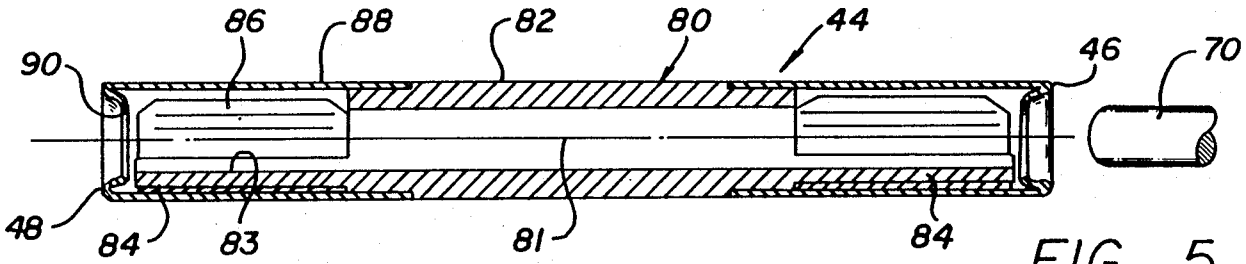
FIG. 5

CONNECTOR SYSTEM WITH MODULAR SOCKET INSERT ASSEMBLY

This is a continuation of application Ser. No. 748,111, filed June 24, 1985, now abandoned.

BACKGROUND OF THE INVENTION

In connector systems used in a hostile environment, such as deep within an oil well, the female or socket ends of contacts are damaged much more often than the male or pin contact ends. Also, cleaning of the deep recess of a socket contact end is much more difficult than of a pin contact end which may have no recesses. A socket device with socket contact ends at both ends of the connector could be used to connect two male or pin ends to avoid the need to reconnect multiple wires to a new connector whenever it is damaged. However, if the module with the sockets at either ends is to be disposed of everytime a socket becomes damaged or very dirty, then the cost would be high. A socket insert assembly which enabled cleaning and replacement of its sockets modules in the field, would facilitate the maintenance of connector systems in the field.

SUMMARY OF THE INVENTION

In accordance with one embodiment of the present invention, a connector system is described, which includes a modular socket insert assembly which can be easily cleaned and repaired in the field. The socket insert assembly includes a pair of insulators having inner ends that substantially abut one another and having outer ends. The assembly also includes a plurality of socket modules that each have a pair of opposite socket ends that can each receive a pin contact to electrically connect a pair of pin contacts. Each insulator has a plurality of through holes, each through hole having a wide diameter portion extending from the inner end of the insulator for receiving a socket module, and a narrow portion near its outer end that is too narrow to pass a socket module so as to retain the socket module therein.

The novel features of the invention are set forth with particularity in the appended claims. The invention will be best understood from the following description when read in conjunction with the accompanying drawings.

BRIEF DESCRIPTION OF THE DRAWINGS

FIG. 2 is a view taken on the line 2—2 of FIG. 1.

FIG. 3 is a partial perspective and exploded view of a socket module of the socket insert assembly of FIG. 1.

FIG. 4 is a sectional view of the socket module of FIG. 3.

FIG. 5 is a view taken on the line 5—5 of FIG. 4.

DESCRIPTION OF THE PREFERRED EMBODIMENT

Figure 1:
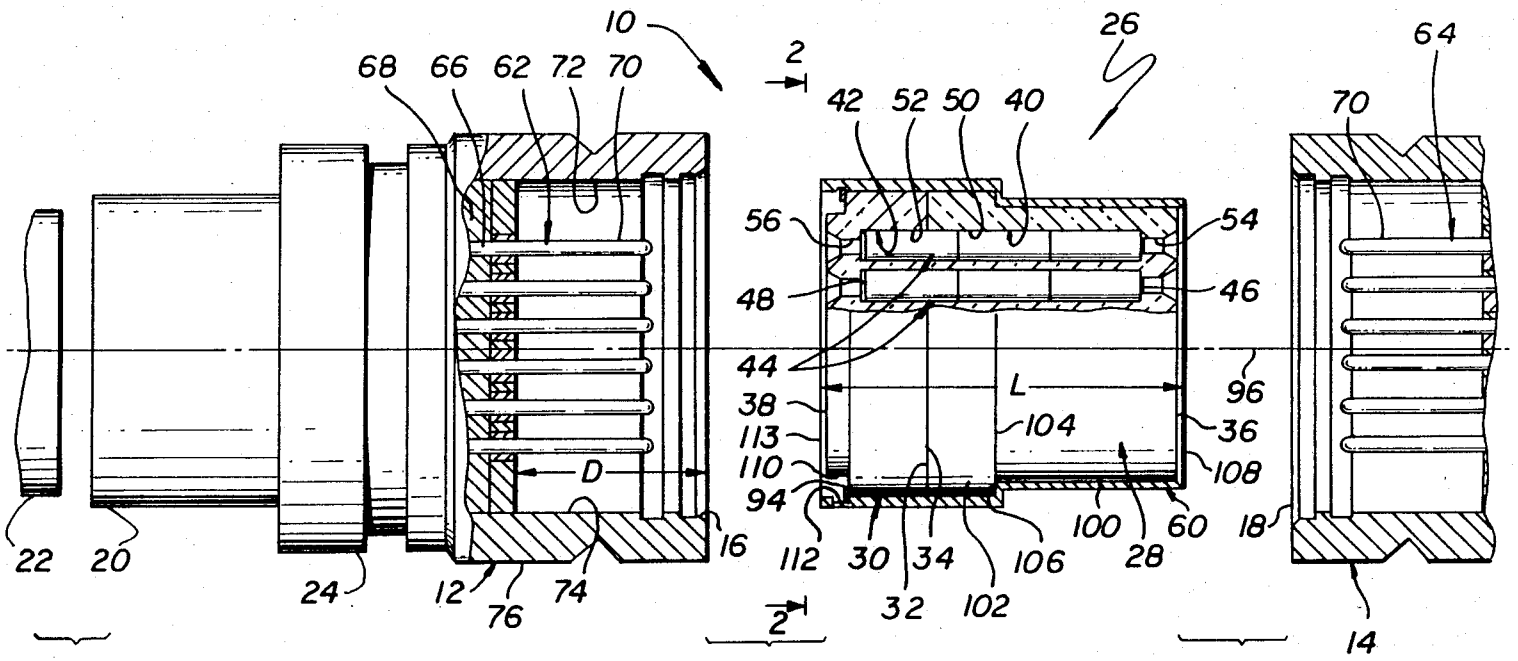
FIG. 1 is an exploded partially sectional view of a connector system constructed in accordance with the present invention.

FIG. 1 illustrates a connector system 10 which can be used in a hostile environment such as deep within an oil well where part or all of the system is subjected to dirt under considerable heat and pressure. The system includes a pair of receptacle connectors 12, 14 having male connector ends 16, 18 that must be interconnected under hostile conditions. In this connnector system, the connector 12 has an opposite end 20 which is also a male end and which connects to a socket connector 22 at the end of a cable, where the connections between the ends 20, 22 are under less than hostile conditions, in as much as a seal applied around the outside 24 of the connector isolates its opposite ends to protect the end 20 from the extreme hostile environment.

The two male connector ends 16, 18 are interconnected by a socket insert or plug assembly or apparatus 26. The socket insert assembly includes two insulators 28, 30 that have inner ends 32, 34 that abut one another, and outer ends 36, 38. Each insulator has a plurality of through holes 40, 42 that extend between its opposite ends. A plurality of socket modules 44 lie in the holes. Each socket module has a pair of opposite socket ends 46, 48 for receiving pin contacts, to interconnect a pair of pin contacts received in its opposite ends. Each hole 40, 42 of the insulators includes a wide diameter portion 50, 52 extending from the inner end of the respective insulator, for receiving the socket module. Each hole also includes a narrow portion 54, 56 near its outer end, which is too narrow to pass a socket module 44, to thereby retain the socket module in place. However, each narrow portion 54, 56 is wide enough to pass a pin contact, so that a pin contact can enter an end of a socket module. A socket insert assembly shell 60 surrounds the two insulators to hold them in, although it is possible to provide other locking means to hold the insulators together.

Each connector includes a group of pin contacts 62, 64 that have middle portions 66 trapped within an insulation member 68 within the connector and are preferably sealed thereto. Each pin contact also has an end 70 that projects from the insulation member into a hollow connector end 72. The contact end is surrounded by a largely cylindrical hollow connector end 74 formed by a shell 76 of the connector. The socket insert assembly 26 is designed to fit into the hollow shell end 74 of either male connector end 16, 18 to receive the pin contact ends 70 therein. The depth D of each hollow connector end is less than the length L of the socket insert assembly. As a result, when one end of the socket insert assembly is fully inserted into a male connector end such as 16, the opposite end of the socket insert assembly projects therefrom and can be inserted into the other male connector end 18 to contact its pin contacts 64. The length L is less than 2D, so the extreme end of the shells can abut one another.

Each socket module 44 has a construction such as is shown in FIG. 5. The socket module includes a body 80 extending along axis 81, with a middle portion 82 and with arcuate opposite end portions 84. A napkin spring 86 fits around each end portion to press a pin contact portion 70 against the inside surface of a body end portion 84. A hood 88 surrounds the end portion 84 of the body and the spring 86 to retain them in place. The hood has an open outer end 9 which is large enough to pass a pin contact but small enough to prevent loss of the spring 86.

Most of the socket modules carry noncritical signals, and have napkin springs which can be deflected by moderate insertion forces. A minority of the socket modules carry critical signals, and low contact resistance then must be assured even when the system is subjected to severe vibrations, shocks, and other disturbances. Where critical signals are carried by a socket module, its napkin spring is stiffer so it applies at least a 50% greater force against a contact, than does a spring of a module carrying noncritical signals. Only a minority of socket modules with stiffer napkin springs are present in a socket insertion assembly, to avoid an excessive connector mating force.

The socket insert assembly 26 (FIG. 1) is designed to facilitate the clean out and replacement of a socket module 44 or insulator in the field. To disassemble the assembly, a snap ring 94 is removed from a slot near one end of the shell 60, which can be easily accomplished with a screw driver blade or knife. The assembly is then turned so that the end 38 is lowermost, so that the two insulators may be removed from the shell 60. The two insulators are then turned upside down so that the end 36 is lowermost. The top insulator 30 can then be lifted off of the other one 28 so that ends of a socket modules 44 project from the inner end 32 of the insulator 28. If one of the socket modules 44 is damaged or a few of them require cleaning, they can be lifted out, cleaned, and then replaced. Alternately, all of the socket modules can be placed in a container and cleaned, and the insulators and their holes can also be cleaned.

One of the insulators 28 is longer, along the axis 96, than the other 30. Reassembly of the socket assembly is accomplished by orienting the longer insulator 28 with its inner end 32 uppermost, and then inserting the numerous socket modules in the holes 50 of the larger insulator. When the socket modules are dropped into the longer holes 50 of the longer insulator, their projecting ends are held sufficiently close in position so that the shorter insulator 30 can fit over them. That is, the module axes are sufficiently parallel to the axes of the insulator holes. The shorter insulator 30 can be lowered into position so that its inner end 34 abuts the inner end 32 of the longer insulator. Thereafter, the projecting upper ends of the socket modules hold the two insulators 28, 30 in alignment. It may be noted that it would be much harder to assemble the socket module by first inserting the socket modules into the shorter insulator 30, because then the projecting ends of the socket modules would not be closely aligned with the insulator holes; then, it would be difficult to drop the longer module over them.

The diameter of the hole 50, 52 of the insulators is at least about 3% greater than the outer diameter of the socket module 44, to permit slight movement of the socket modules to accomodate the precise spacing of the pin contacts that they receive. In prior connector systems wherein each half is hermetically sealed, only very slight misalignment of mating contacts can be tolerated. However, in the present socket modules both ends of a module are free and the modules can "float" within the insulator, and the spring which engages an inserted pin contact allows more than prior socket deflection. This allows a much greater degree of contact misalignment without degrading the contact arrangement, and provides an automatic cleaning action on both the pin and socket contacts during mating and unmating, and even by reason of axial float while the contacts are mated.

After assembling the two insulators with the socket modules therein, the two insulators as a unit are dropped into the shell 60. The longer insulator 28 has two different outside portions 100, 102 of different diameters, the portion 102 nearest the inner end 32 of the insulator being of larger diameter. This forms a ledge 104 at the intersection of these different diameter portions. The shell has two different outside diameters to form an inside shoulder 106 on which the ledge 104 rests. The insulators are freely slidable into the shell, until the ledge 104 rests on the shoulder 106, to prevent the insulators from moving further towards a first end 108 of the shell. The snap ring 94 is then installed around a cut away portion 110 at the outer end of the short insulator and into a groove 112, to prevent the insulators from moving towards a second end 113 of the shell. The assembly and reassembly of the socket insert assembly is relatively easy and, as mentioned above, can be performed rapidly in the field without any tools except for a screwdriver, knife, or the like.

Thus, the invention provides a connector system which includes a socket insert assembly that can connect the male ends of a pair of connectors. The socket insert assembly includes individual socket modules that can be easily removed for replacement or cleaning in the field.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. A connector system comprising:

(a) A pair of receptacle connectors and a separate plug assembly for mounting with and between said receptacle connectors;

(b) each said receptacle connector having a shell with a hollow end portion, said shell holding an insulation member containing a plurality of spaced pin contacts extending into said hollow end portion, with the pin contacts arranged in a predetermined pattern;

(c) said plug assembly comprising:

(i) a housing, other than said shells, containing first and second insulators, each said insulator having an inner end that substantially abuts the inner end of the other insulator, and each having an outer end, said insulators forming a plurality of through holes arranged in a pattern corresponding to the pattern of said pins;

(ii) a plurality of elongated socket modules each mounted in a respective one of said through holes, each said socket module having a pair of opposite ends with holes for receiving the pin contacts of said receptacle connectors;

(iii) each said through hole having a wide diameter portion extending from the inner end of the insulator for receiving a socket module, and each said through hole having a narrow portion near its outer end that is too narrow to pass the socket module therethrough, said wide diameter portions being long enough to receive said socket modules, with opposite ends of each socket module lying in different ones of said insulators;

(iv) means for releasably holding said first and second insulators together in said housing with said socket modules in the insulators to form a self-contained assembly, said holding means permitting intentional removal of the insulators from said housing to remove and replace the socket modules therein; and (d) each end of said plug assembly being slidably insertable into a different one of said connector hollow ends with the pins of said receptacle connectors received in the ends of said socket modules, said plug assembly being withdrawable from said receptacle connectors by sliding the plug assembly out of said connector hollow ends.

* * * * *